US005291833A

United States Patent [19]

Boual

[11] Patent Number: 5,291,833

[45] Date of Patent: Mar. 8, 1994

[54] ARMOR-PIERCING FRAGMENTATION SUBCALIBER PROJECTILE

[75] Inventor: Roland Boual, Saint-Germain-du-Puy, France

[73] Assignee: Giat Industries, Versailles Cedex, France

[21] Appl. No.: 940,871

[22] PCT Filed: Feb. 17, 1992

[86] PCT No.: PCT/FR92/00154

§ 371 Date: Oct. 30, 1992

§ 102(e) Date: Oct. 30, 1992

[87] PCT Pub. No.: WO92/14984

PCT Pub. Date: Sep. 3, 1992

[30] Foreign Application Priority Data

Feb. 26, 1991 [FR] France ..... 91 02248

[51] Int. Cl.[5] ..... F42B 12/06

[52] U.S. Cl. ..... 102/506; 102/510; 102/518

[58] Field of Search ..... 102/506, 510, 517, 518, 102/519

[56] References Cited

U.S. PATENT DOCUMENTS

| | | | |
|---|---|---|---|
| 1,709,414 | 4/1929 | Stendebach . | |
| 3,097,603 | 7/1963 | Harper . | |
| 3,103,889 | 9/1963 | Keeney, Sr. . | |
| 4,301,737 | 11/1981 | Yuhash et al. . | |
| 4,708,064 | 11/1987 | Bisping et al. . | |
| 4,770,102 | 9/1988 | Bisping et al. | 102/506 |
| 4,970,960 | 11/1990 | Feldman | 102/506 |
| 4,977,834 | 12/1990 | Denis | 102/517 |

FOREIGN PATENT DOCUMENTS

| | | | |
|---|---|---|---|
| 2543287 | 9/1984 | France . | |
| 13864 | of 1903 | United Kingdom | 102/517 |
| 2011041 | 7/1979 | United Kingdom . | |
| 2212251 | 7/1989 | United Kingdom . | |

*Primary Examiner*—Harold J. Tudor
*Attorney, Agent, or Firm*—Oliff & Berridge

[57] ABSTRACT

A projectile for an armored target is characterized in that the body consists of a block of dense material with a frustoconical axial bore, its large end opening in the plane of face of the body. The transmission element consists of a rod extending from the rear face of the head and comprises a seating engaged in the bore to leave a clearance between the rear face of the head and the front face, and the body and the nose are locked in a position where the rod is engaged in the bore. Application to armor-piercing fragmentation shells.

11 Claims, 1 Drawing Sheet

ARMOR-PIERCING FRAGMENTATION SUBCALIBER PROJECTILE

BACKGROUND OF THE INVENTION

The present invention relates to projectiles of the subcaliber type and relates more specifically to such projectiles designed to possess high firing accuracy and substantial terminal efficiency.

Destruction of a target at a relatively long distance may be attempted from a projectile that explodes on impact.

While such projectiles have a substantial terminal efficiency, on the other hand, they have relative accuracy due to their design.

Moreover, such projectiles are expensive and require very strict storage and handling precautions to prevent their unintended explosion.

SUMMARY OF THE INVENTION

The goal of the present invention is to provide a new projectile able to possess a high impact energy, have reliable firing accuracy, and develop substantial terminal efficiency without using an on-board explosive charge.

More specifically, the invention is directed to an armor-piercing, fragmentation, subcaliber projectile which can be made at low cost by machining and assembly in automatic production lines, which is reliable in handling after manufacture, and which reliably combines the properties of high impact energy, firing accuracy, and substantial terminal efficiency.

To achieve the above objectives, the projectile according to the invention is characterized in that:

- the body is composed of a block of dense material, with a frustoconical axial bore whose large base opens at the plane of the front face of the anterior part of the body,
- the transmission element is composed of a tail extending axially from the rear face of the head and having at least one frustoconical support which is engaged to rest on the frustoconical bore of the body so as to leave some play between the rear face of the head and the front face,
- and the body and head are immobilized in the engagement position of the tail in the bore.

BRIEF DESCRIPTION OF THE DRAWINGS

Various other characteristics will emerge from the description below which refers to the attached drawings showing, as nonlimiting examples, embodiments of the subject of the invention.

DETAILED DESCRIPTION OF THE PREFERRED EMBODIMENTS

Figure 1:
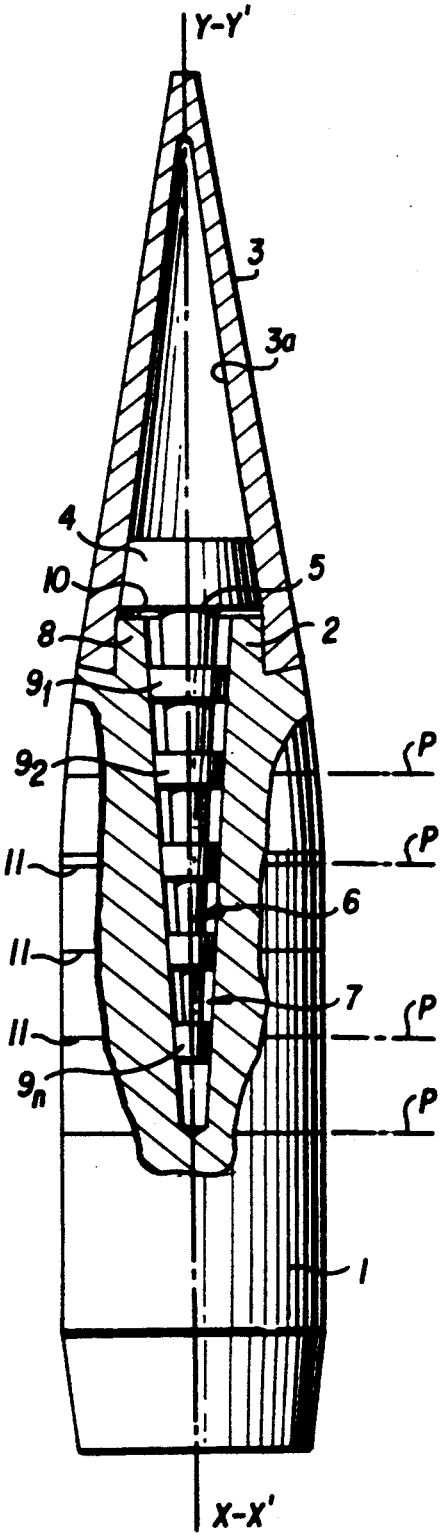
FIG. 1 is a partially cut away elevation section of a first embodiment of the subject of the invention.

According to the example illustrated in FIG. 1, the projectile according to the invention, of the armor-piercing subcaliber type, has a body 1 made of a dense material such as tungsten, tungsten carbide, impoverished uranium, etc. Body 1 is generally cylindrical and has an axis of revolution x-x'.

Body 1 is cut off at its anterior part to delimit an end part 2 able to accept installation by crimping or banding of a ballistic nose cone 3 made of a malleable material having good air penetration characteristics, such as a light alloy or a copper alloy.

Nose cone 3 also serves to hold a head 4 which has an axis of revolution y-y' designed to be aligned with axis x-x', Head 4, frustoconical for example, is located abutting a matching hollow 3*a* of the nose cone. Means other than frustoconical cooperation could be provided to axially immobilize head 4. Head 4 is extended from its rear face 5 by a tail 6 that is engaged in an axial bore 7 of body 1, starting at front face 8 of end part 2. Tail 6 can be an integral part of head 4 or consist of an independent part.

Bore 7, in the example illustrated, is of the blind frustoconical type, and its large base opens at the plane of front face 8. Bore 7 matches the general shape of tail 6 which also has a frustoconical shape of the continuous or preferably segmented type. Tail 6 includes successive frustoconical supports $9_1, 9_2, \ldots 9_n$ with the same angle at the center, alternating with cut-off sections with a smaller cross section. Axial immobilization of head 4, for example by nose cone 3, is provided in matching fashion between bore 7 and frustoconical supports 9 such that, when these supports rest on the peripheral wall of bore 7, a gap or play 10, for example between 0.05 and 0.5 mm, is present between rear face 5 of head 4 and front face 8 of end part 2.

Body 1 can advantageously have areas of less resistance 11 which can be disposed axially or, preferably, in planes P transverse to axis x-x'. If there is a plurality of areas of less resistance 11, they may or may not be arranged such as to be axially equidistant. These zones of less resistance 11 can be produced in any appropriate fashion known in the prior art.

In the preferred case of there being areas 11 established transversely, frustoconical supports 9 of tail 6 are arranged such that, in the position where they rest inside bore 7, at least some of supports 9 are located in or substantially in planes P of at least some of areas 11 of less resistance.

The projectile of the armor-piercing fragmentation shell type described above, is characterized by a static state in which it has no explosive charge and hence is very safe to produce, install, and handle.

The projectile in the subcaliber form provided with nose cone 3 corresponds to an armor-piercing projectile that has good impact energy and firing accuracy characteristics.

On impact with a target, a relative movement occurs between the head and body 1 because of the existence of gap 10. The relative axial displacement of body 1 has the effect of causing tail 6 to assume the function of a thruster transmitting relative axial thrust, by means of supports 9 which penetrate inside bore 7, exerting a radial force on the peripheral envelope of body 1 that delimits this bore. As a result, body 1 is placed under radial stress which, in combination with the shock wave, favors fragmentation of body 1, particularly at the areas of less resistance 11, if any.

The projectile according to the invention thus has substantial terminal efficiency due to its fragmentation upon impact, which allows the characteristics of firing accuracy and terminal efficiency to be combined by implementing only one projectile of the armor-piercing, fragmentation type.

It must be considered that fragmentation of body 1 may occur by the same penetrating cone effect brought about by tail 6 which could be made in the pure conical form by replacing the various successive supports 9.

Figure 2:
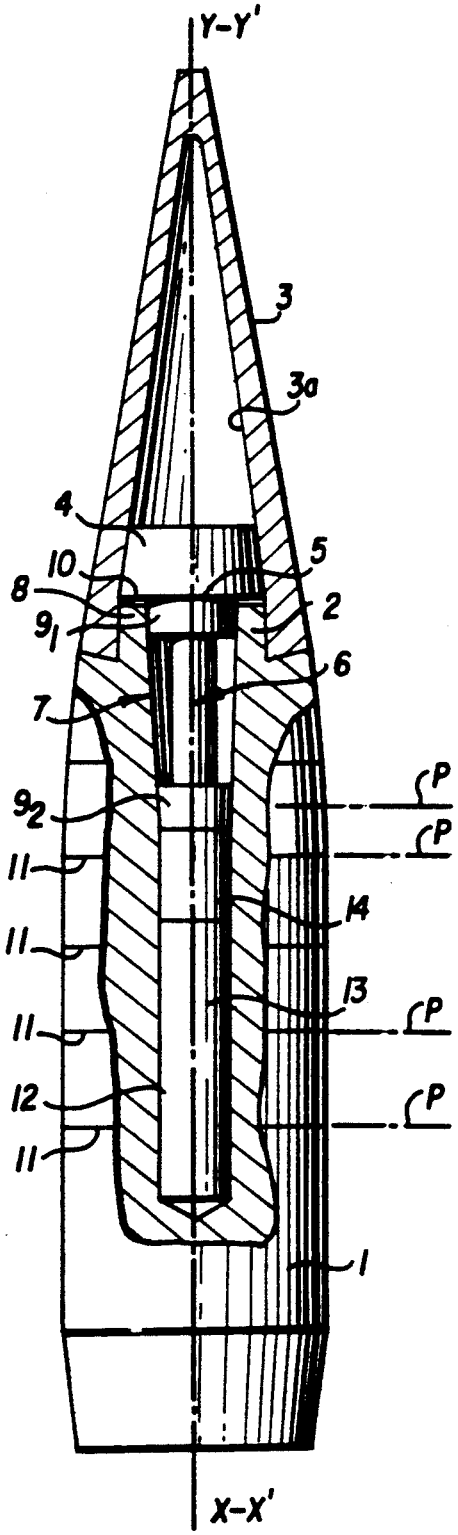
FIG. 2 is a partially cut away elevation section of another embodiment of the invention.

FIG. 2 shows an alternative embodiment in which tail 6 has two supports $9_1$ and $9_2$ designed to cooperate with frustoconical bore 7. A cylindrical bore 12 extends beneath the frustoconical bore as viewed in FIG. 2, and axially inside body 1 to intersect at least one of transverse planes if areas of less resistance 11 exist. Head 4 is mounted, as stated above, such as to cause supports $9_1$ and $9_2$ to rest against frustoconical bore 7, while leaving gap 10.

Installation of head 4 is, however, performed after a block 13, made of material which is radially deformable when subjected to radial compression, such as rubber, has been placed inside bore 12. Installation is thus effected such that tail 6 is extended by a cylindrical end part 14 that must be kept in contact with the corresponding transverse face of block 13. Cylindrical and part 14 can be composed of an independent part, or of an extension of tail 6 extending beyond frustoconical support $9_2$.

The operation of the projectile on impact is of the same kind as described above, due to the presence of gap 10. Indeed, relative displacement of body 1 relative to head 4 results in forced engagement with a wedging effect of supports $9_1$ and $9_2$ inside frustoconical bore 7, locally subjecting body 1 to radial stresses. Moreover, the penetration of tail 6 pushes cylindrical-end part 14, whose function it is to apply an axial force to block 13, so as to place the part of body 1, which may be intersected by at least one of the transverse planes of an area of less resistance (11), under radial stress. Thus, in combination with the shock effect, the radial stresses imposed locally on body 1 causes fragmentation of the latter, simultaneously with perforation of the target by head 4.

The invention is not confined to the examples described and represented, as various modifications may be made thereto without departing from its scope.

I claim:

1. A perforating fragmentation non-explosive charge containing subcaliber projectile having a body made of a dense material, a head adjacent a front part of the body, and a transmission element for transmitting axial thrust interposed between the body and the head, wherein the body comprises a block of dense material and a frustoconical axial bore, an open end of the axial bore being aligned with a front face of the front part of the body, the body having at least one area of less resistance established transversely to the longitudinal axis of the body, the transmission element comprises a tail extending axially from a rear face of the head into the axial bore and having at least one frustoconical support engaging the axial bore of the body so as to leave a space between the rear face of the head and the front face, said at least one frustoconical support being located substantially in a transverse plane of the at least one area of less resistance, and the body and the head are immobilized by the at least one frustoconical support of the tail engaging the bore, whereby upon impact, a relative axial displacement of the body due to said space causes said at least one frustoconical support to exert a radial force on the body thereby causing multiple fragmentation of the body.

2. A projectile according to claim 1, wherein the body and the head are immobilized by a nose cone fitted onto the body.

3. A projectile according to claim 1, wherein the tail is integral with the head.

4. A projectile according to claim 1, wherein the tail includes a cylindrical end part slidably engaged in a cylindrical bore provided in the body extending from the frustoconical axial bore and resting against a block of material able to deform radially under axial compression.

5. A projectile according to claim 4, wherein the cylindrical end part being an independent cylinder.

6. A projectile according to claim 4, wherein the block of material is made of rubber.

7. A projectile according to claim 2, wherein the tail has a plurality of frustoconical supports, a corresponding at least one of said frustoconical supports being located substantially in a transverse plane of the at least one area of less resistance.

8. A projectile according to claim 2, wherein the tail is integral with the head.

9. A projectile according to claim 2, wherein the tail includes a cylindrical end part slidably engaged in a cylindrical bore provided in the body extending from the frustoconical axial bore and resting against a block of material able to deform radially under axial compression.

10. A projectile according to claim 3, wherein the tail includes a cylindrical end part slidably engaged in a cylindrical bore provided in the body extending from the frustoconical axial bore and resting against a block of material able to deform radially under axial compression.

11. A perforating fragmentation non-explosive charge containing subcaliber projectile having a body made of a dense material, a head adjacent a front part of the body, and a transmission element for transmitting axial thrust interposed between the body and the head, wherein the body comprises a block of dense material and a frustoconical axial bore, an open end of the axial bore being aligned with a front face of the front part of the body, the transmission element comprises a tail extending axially from a rear face of the head into the axial bore and having at least one frustoconical support engaging the axial bore of the body so as to leave a space between the rear face of the head and the front face, the tail includes a cylindrical end part slidably engaged in a cylindrical bore provided int eh body extending from the frustoconical axial bore and resting against a block of material able to deform radially under axial compression, and the body and the head are immobilized by the at least one frustoconical support of the tail engaging the bore, whereby upon impact, a relative axial displacement of the body due to said space causes said at least one frustoconical support to exert a radial force on the body thereby causing multiple fragmentation of the body.

* * * * *